US005476415A

United States Patent [19]

Nishimura et al.

[11] Patent Number: 5,476,415

[45] Date of Patent: Dec. 19, 1995

[54] DRY BARREL FINISHING MACHINE

[75] Inventors: Kazutoshi Nishimura, Niwa; Yoshinori Kohketsu, Inazawa; Takao Ishida, Nishikasugai, all of Japan

[73] Assignee: Sintobrator, Ltd., Aichi, Japan

[21] Appl. No.: 141,267

[22] Filed: Oct. 22, 1993

[51] Int. Cl.[6] ..... B24B 31/00

[52] U.S. Cl. ..... 451/326; 451/327; 451/329

[58] Field of Search ..... 451/32, 326, 327, 451/88, 87, 89, 456

[56] References Cited

U.S. PATENT DOCUMENTS

| | | | |
|---|---|---|---|
| 3,570,192 | 3/1971 | Ferrara | 451/327 |
| 4,231,196 | 11/1980 | Jones | 451/32 |
| 4,727,684 | 2/1988 | Kobayashi et al. | 451/329 |
| 5,012,620 | 5/1991 | McNeil | 451/327 |
| 5,279,074 | 1/1994 | Davidson | 451/326 |
| 5,305,554 | 4/1994 | Emken et al. | 451/326 |

*Primary Examiner*—Bruce M. Kisliuk
*Assistant Examiner*—Derris Banks
*Attorney, Agent, or Firm*—Fish & Neave; Edward Etkin

[57] ABSTRACT

An improved dry barrel finishing machine is described, in which a mass consisting of media and workpieces is flowed in the barrel of the machine for abrasive finishing of the workpieces and in which air suction is used to remove dust resulting from the finishing operation and to cool the barrel and the mass. The mass is flowed by rotation of the barrel by a motor or through the vibration of the barrel by a driving mechanism. Air inlets and outlets are provided in the barrel. An air suction device draws air through the barrel and around the workpieces and media during the finishing operation. The drawn out air picks up dust and media particles resulting from the abrasive finishing operation and cools the media and the barrel.

13 Claims, 6 Drawing Sheets

DRY BARREL FINISHING MACHINE

BACKGROUND OF THE INVENTION

This invention relates to a dry barrel finishing machine and a method of dry barrel finishing, wherein a media and workpieces are flowed in the barrel of the machine for fine abrasive finishing of the workpieces.

Generally, barrel finishing is well known as a method for finely grinding workpieces such as bolts, shafts, bearings, etc. In barrel finishing, a mass, which is comprised of media and workpieces, is charged into a receptacle, i.e. a barrel, and the barrel is activated to flow the mass in it to finish the workpieces through interactive attrition between the workpieces and the media.

Barrel finishing includes dry finishing and wet finishing. Wet finishing uses compounds and water as well as a media, while dry finishing does not use fluid. Wet barrel finishing requires washing and drying workpieces after the finishing as well as water treatment for removing waste attrition fluid and waste washing water. It is well known that a drawback of wet barrel finishing is that it requires a drying apparatus and a fluid treatment device, and therefore it requires more space for these items. Another drawback is that wet barrel finishing takes additional time and labor.

In view of such drawbacks, dry barrel finishing is often used. In dry barrel finishing, however, attrition produces dust and fragments of the media. Further, frictional heat is generated due to the attrition between the workpieces and the media, and between the barrel and the mass. The attrition dust tends to spread out of the barrel and contaminate the environment. The dust also causes clogging in the media, lowering the abrasive ability of the media, and resulting in uneven finishing on the workpieces. Further, in a conventional centrifugal barrel finishing machine, which has an upper immobile tank and a bottom rotary disc, fragments of the media tend to get caught in the space or slit between the rotary disc and the immobile tank. If any fragment becomes jammed in the slit, the rotating disc and the tank are heavily rubbed thereby, and a frictional heat of high temperature will be generated. This heat tends to melt any liners covering the surfaces of the disc and the tank, and as a result, fragments adhere to these liners, thereby hindering the rotation of the disc.

Recently, artificial plastic media have been used as barrel finishes. This plastic media is generally produced by externally heating, in a mold, a mixture of abrasive material and grains of bonding material of an unsaturated polyester resin, a polyvinyl chloride resin, etc. Through this external heating, if the entire mixture is sufficiently heated, a skin layer of the bonding material is formed on the outside of the medium. On the contrary, if the mixture is heated such that only the outside is heated so as to prevent such a skin layer on the surface of the media, the inner part of the media will be brittle because the abrasive material and the bonding material have not been combined sufficiently. This resulting brittle media will cause fragments during barrel finishing, and the fragments will be jammed in the slit of the barrel as described above.

Japanese Patent (Y) 2-43,652 discloses an improved plastic media which is, for example, in the shape of a cylinder. This media is porous and has no skin layer on the outer surface. The media contains abrasive grains combined with the bonding material and pores between the abrasive grains. Since the abrasive grains are separated by pores and are always exposed, they are effective.

SUMMARY OF THE INVENTION

The primary purpose of the present invention is to provide a dry barrel finishing machine equipped with an air suction device and a dust collector for sucking air in the barrel so that air can flow through the barrel and remove the attrition dust produced during barrel finishing. The air flow also reduces the frictional heat evolution of the mass and the barrel.

The barrel may be a centrifugal type equipped with a rotary plate or a vibratory type equipped with a driver.

Using a media which is porous and has no outer skin layer of bonding material is preferable for the purpose of dry barrel finishing.

DESCRIPTION OF THE PREFERRED EMBODIMENTS

Figure 1:
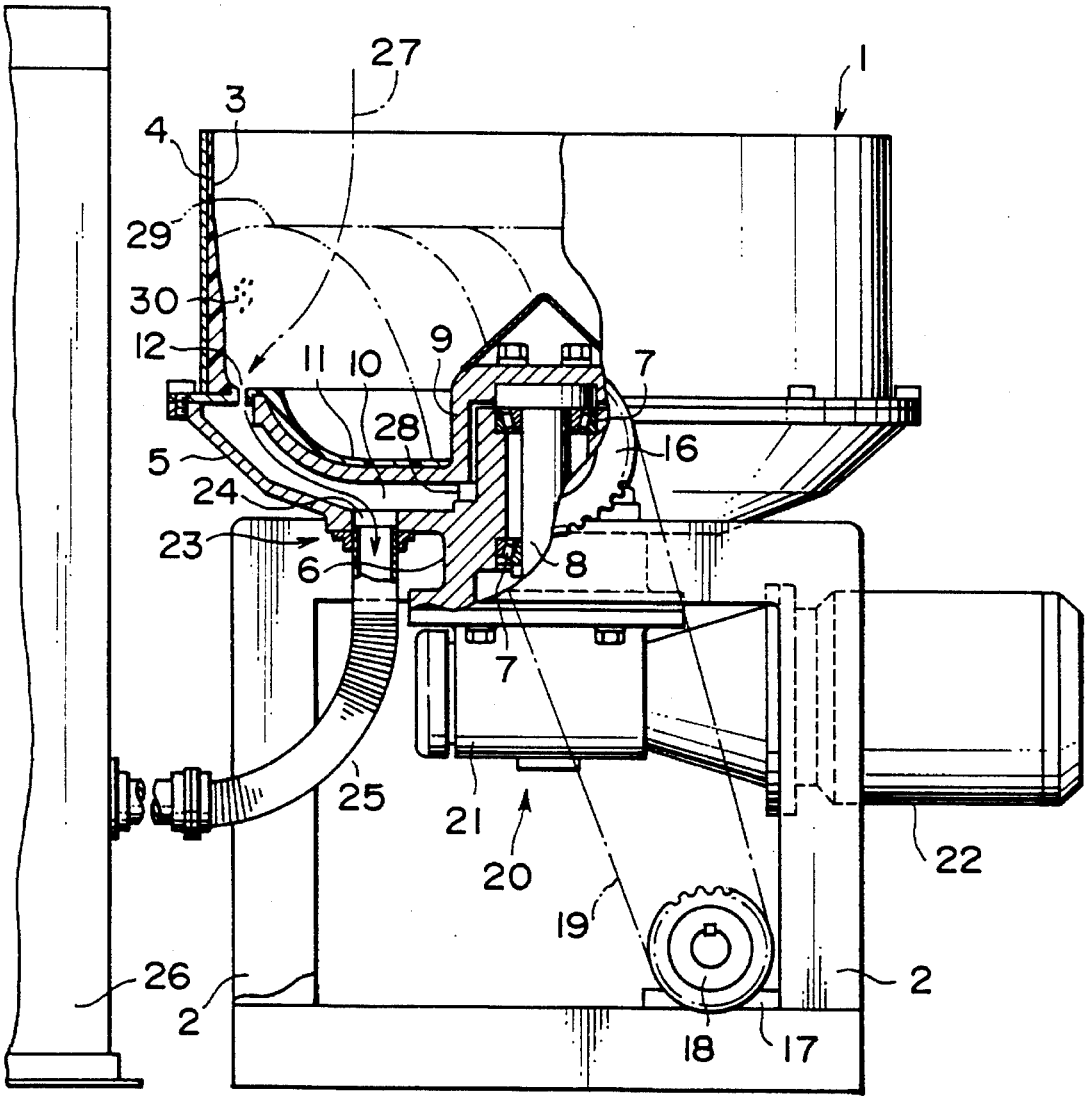
FIG. 1 is a partially sectional front view of a dry-type barrel finishing machine of the present invention.
Figure 2:
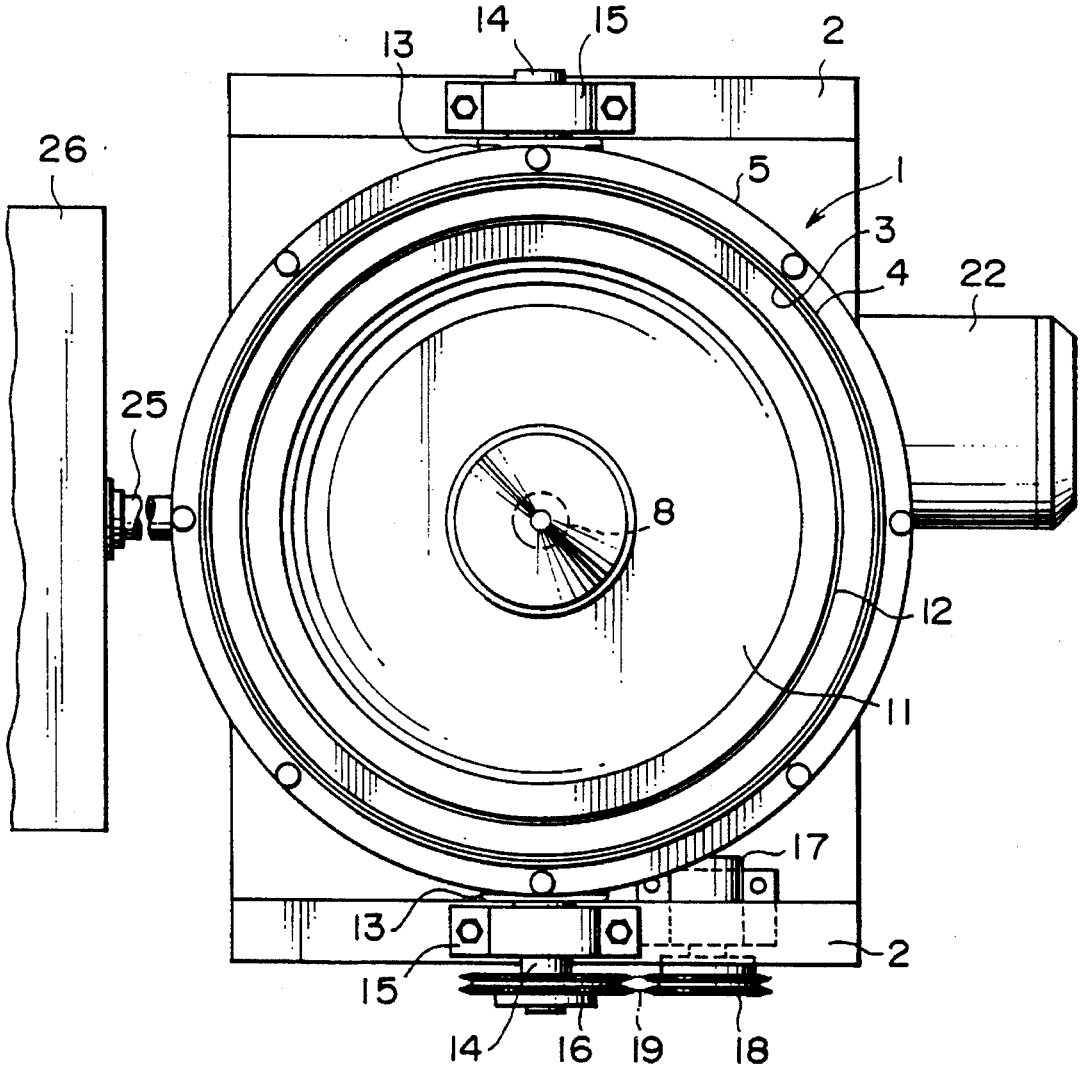
FIG. 2 is a plan view of the machine of FIG. 1.

In FIGS. 1 and 2, a dry barrel finishing machine of an embodiment of the present invention is shown. The barrel finishing machine has a centrifugal barrel 1. The barrel 1 is mounted between a pair of portal frames 2, 2 which serve as a base for the barrel. The barrel 1 accommodates workpieces and media and causes them to flow in it for the abrasive finishing of the workpieces. The barrel 1 includes a fixed cylindrical tank 4, a disc-shaped plate or dish 5 for supporting the tank 4, and a bottom rotary plate 9. A liner 3 is attached to the inner surface of the cylindrical tank 4. The supporting plate 5 is integrally mounted on a cylindrical boss 6. The rotary plate 9 is disposed above the supporting plate 5 and is fixed by fasteners, such as bolts, to a vertical shaft 8 which is positioned within the boss 6 and is mounted rotatably to the boss 6 via bearings 7, 7 for the smooth rotation of the shaft 8.

As shown in FIG. 1, the circumferential edge and the upper surface of a part of the rotary plate 9 are covered by a liner 11 so that there is a circular slit 12 between the liner 11 on the edge of the rotary plate 9 and the liner 3 on the lower portion of the cylindrical tank 4. The width of the slit is so small that the media and workpieces can not get into it. A space 10 between the supporting plate 5 and the bottom rotary plate 9 communicates through the slit 12 with a space above the rotary plate 9 so that air entraining any attrition dust can flow between the spaces.

A driving unit 20 is attached to the boss 6 and is operatively coupled to the vertical shaft 8 for rotating the bottom rotary plate 9 about the axis of the vertical shaft 8. The unit 20 includes, in this example, reduction gears 21 and a motor 22 for driving the reduction gears 21.

As clearly shown in FIG. 2, the supporting plate 5 at both sides (the top and the bottom in FIG. 2) is provided with a pair of arms 13, 13 which are connected to shafts 14, 14. The shafts 14, 14 are rotatably supported on bearings 15, 15 mounted on the frames 2, 2. Thus, the barrel 1 including the tank 4 and plates 5, 9, the boss 6, the vertical shaft 8 in the boss, and the driving unit 20 are supported by the frames 2, 2 through the shaft 14, 14.

A sprocket wheel 16 is attached to one of the shafts 14, 14. A motor 17 is mounted on the frames 2, 2 at a lower portion, and a sprocket wheel 18 is attached to the output shaft of the motor 17. A chain belt 19 is engaged with the wheels 16, 18. Thus, the motor 17 is operatively coupled to the barrel 1. Therefore, the barrel rotates about the axis of the arms 13, 13 when the motor 17 operates.

An air suction device 23 is disposed under the supporting plate 5. The device 23 includes a suction hole 24 formed in the bottom portion of the supporting plate 5, and a flexible duct 25. One end of the flexible duct 25 is connected to the suction hole 24, and the other end is connected to a dust collector 26. The dust collector may be installed on the floor or any other suitable place and is connected to a vacuum source (not shown).

Figure 3:
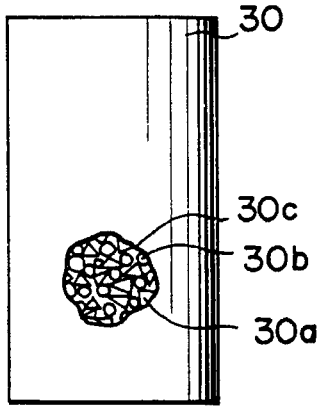
FIG. 3 is a partially sectional front view of a media used for the barrel finishing machine of this invention.

In FIG. 3, a media piece 30, which is used for finishing, is shown. This media piece 30 is disclosed in the above-mentioned Japanese Patent (Y) 2-43,652 and is suitable for use in the dry barrel finishing machine of the present invention. To produce the media pieces 30, a mixture comprised of a certain amount of abrasive grains 30*a* and of plastic grains 30*b* for bonding the abrasive grains 30*a* is dropped into a mold. The abrasive grains 30*a* may be ceramics containing any zirconium oxide grains, aluminum oxide grains, silicon carbide grains, titania grains, etc. of mesh size 60–1500. The plastic grains 30*b* may be selected from the group of a phenolic resin, urea resin, melamine resin, epoxy resin, etc., of which the dielectric loss factor (10 c/s–10 6 c/s) is more than 0.02. The mold may be, for example, made of a silicon gum, of which the dielectric loss factor (10 c/s–10 6 c/s) is more than 0.02. The mixture in the mold is then compressed. After compression, the mixture is heated for 0.5–3 minutes by a high-frequency heater so that the resin 30*b* is melted and the abrasive grains bonded completely. The media piece 30, thus produced, is porous because it contains small pores 30*b* which are evenly spread in the cylindrical body. Therefore, the media piece is not covered with a skin layer of resin, and abrasive grains 30*a* are exposed. When the media is rubbed against workpieces during the finishing operation, the abrasive grains 30 are always exposed.

Now, the operation of this dry-type barrel finishing machine will be explained. The barrel 1 is kept horizontal, and a suitable amount of workpieces and media are placed in the barrel. Then, the motor 22 of the driving unit 20 is operated to transmit the driving power through the reduction gears 21 and the vertical shaft 8, thereby causing the rotary plate 9 to rotate horizontally. The mass consisting of the media and the workpieces advances along the inner surface of the tank 4 by taking a spiral motion as shown by exemplary lines 29 in FIG. 1.

During the finishing process, the workpieces can be effectively finished since the abrasive grains 30*a*, which serve as effective blades, are always exposed when the media 30 pieces are worn. Since the vacuum source and dust collector 26 are activated during finishing, air above the tank 4 is caused to flow in the direction shown by 27 and through the circular slit 12, the space 10, and the duct 25 into the dust-collecting device 26. This air flow prevents the attrition dust produced during barrel finishing from spreading out upwardly from the tank 4. The attrition dust becomes entrained in the air and guided into the dust collector 26. The dust in the device 26 may be disposed of subsequently. This air flow, which passes through the tank 4, also serves to lower the frictional heat of the mass and the barrel caused during the abrasive finishing.

After the finishing is completed, motor 17 is operated to rotate the barrel 1 about the axis of the horizontal arms so that the mass in the barrel is discharged from the opening of the tank 4. The barrel is then returned to the original position.

Although the machine does not require any cover for the tank 4, a simple tank cover having apertures in it may be provided, if desired. In any case, the top of the barrel must be open to air to cause an air flow in the barrel. In the embodiment shown in the drawings, the mass can be discharged easily from the top of the barrel. Further, since all elements for the operation of the barrel 1 are disposed in the frames 2, 2 thereunder, the machine can be compact.

Figure 4:
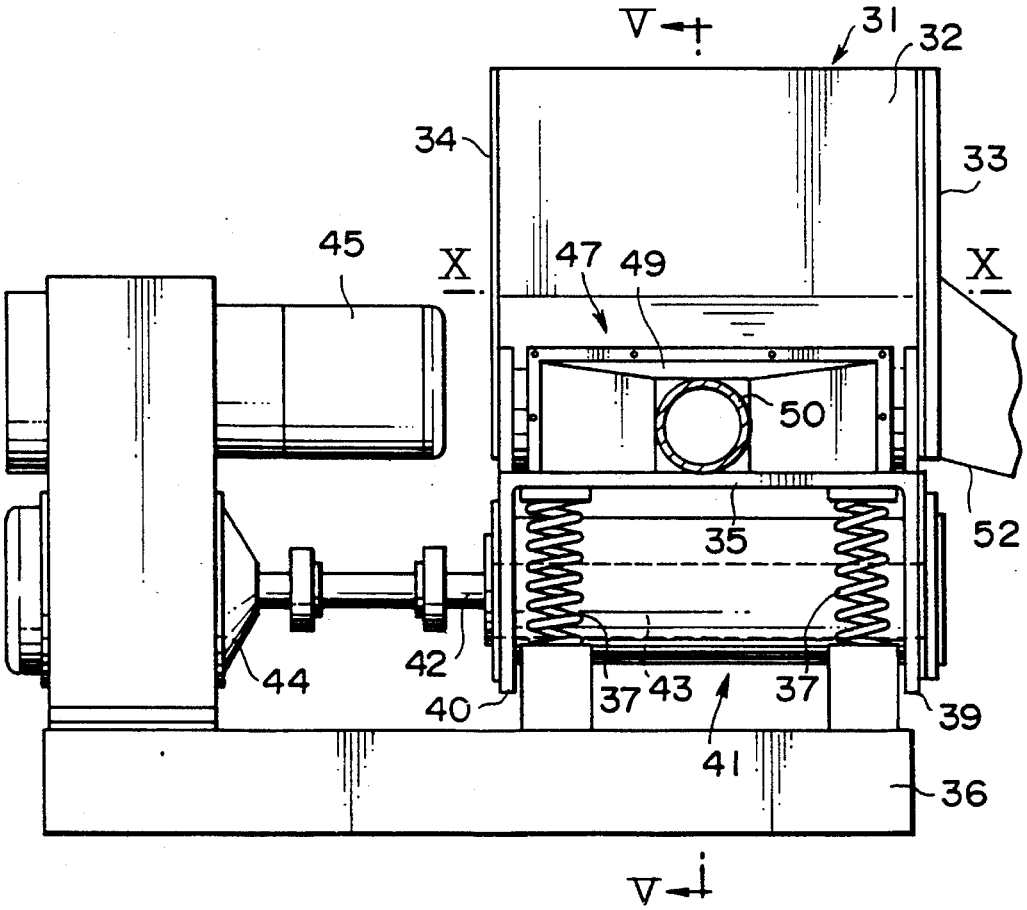
FIG. 4 is a front view of a dry-type barrel finishing machine of the present invention in which a vibratory barrel is used.
Figure 5:
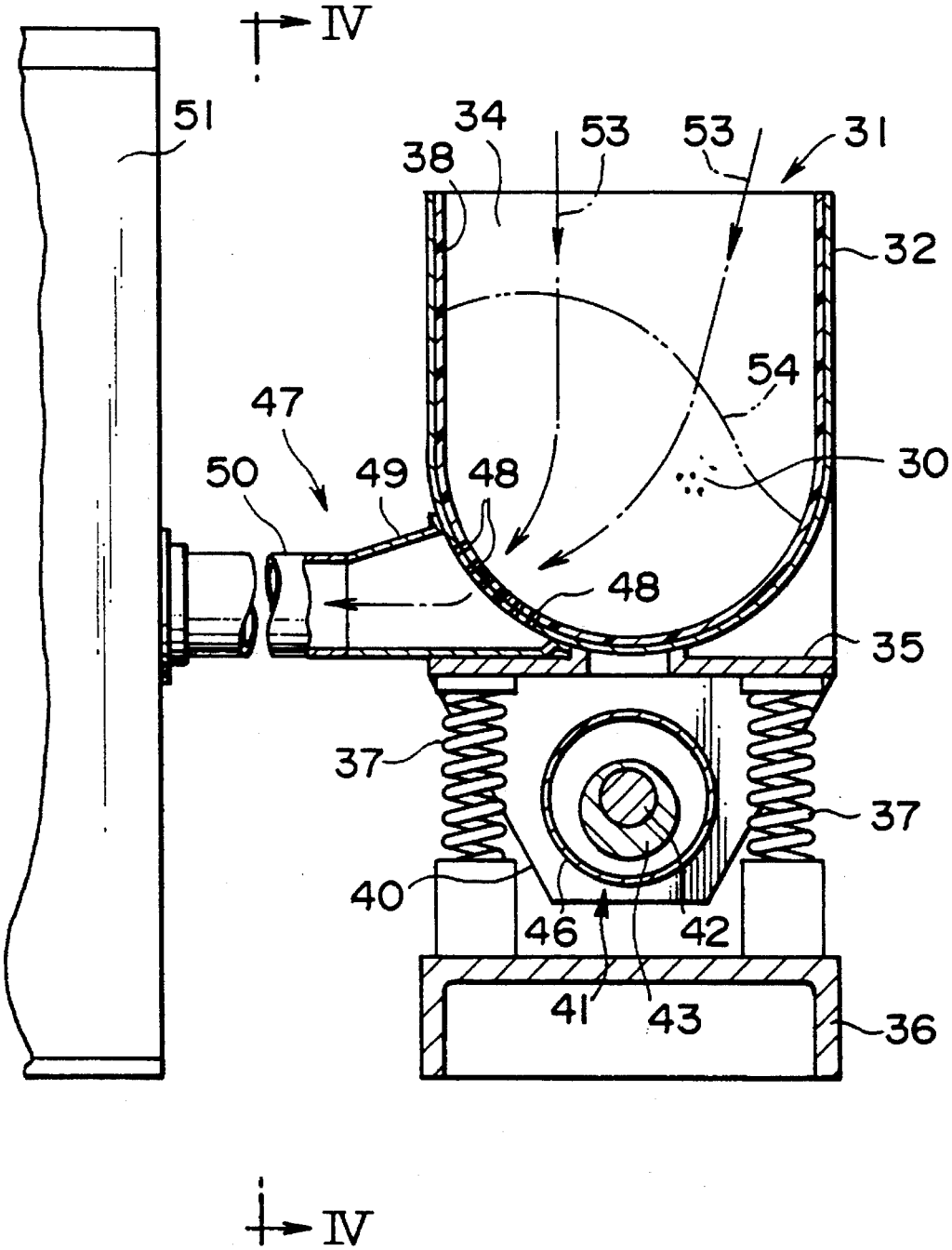
FIG. 5 is a sectional view taken along the line V—V of FIG. 4.

In FIGS. 4 and 5, another dry barrel finishing machine is shown. FIG. 4 is a front view of the machine taken along the line IV—IV of FIG. 5. The tub or barrel 31 of the machine has, for example, a U-shaped cross section of which the lower part is semicircular as shown in FIG. 5. The barrel 31 has a U-shaped wall 32 and side walls 33, 34 secured to the sides of the U-shaped wall 32. Alternatively, the tub may have a flat bottom. The barrel 31 is fixed to a table 35. The table 35 supporting the barrel 31 is elastically supported by a plurality of elastic members, for example, coil springs 37 which are in turn secured to a base 36. The inner surfaces of the barrel are covered by liners 38 as shown in FIG. 5.

A driver 41 is mounted between two upright hanging side walls 39, 40 of the table 35. The driver 41 includes a rotary shaft 42 and a round bar 43 eccentrically fitted on the rotary shaft 42. The rotary shaft 42 is parallel to the longitudinal axis X—X of the barrel. The eccentric round bar 43 is rotatably mounted in holes formed in the hanging side walls 39, 40. One end of the rotary shaft 42 is connected to reduction gears 44, and a motor 45 is operatively coupled to the reduction gears 44. The rotary shaft 42 and the bar 43 are enclosed by a cylindrical cover 46.

When the motor 45 is operated to rotate the shaft 42, the eccentric round bar 43 rotates and pushes the upright side walls 39, 40 of the table 35 in all directions perpendicular to the axis of the shaft 42. Therefore, thanks to the coil springs 37, the table 35 moves or vibrates vertically and horizontally. This causes the mass in the barrel to flow as shown by an exemplary flow line 54, whereby dry finishing of the workpieces by the media 30 is effectively carried out.

Like the machine of the first embodiment described above, an air suction device 47 is also provided for this machine. At the bottom portion of the barrel 31, a plurality of small vents 48 are formed. A hood 49 is attached at one end to the bottom portion of the barrel to communicate with the interior of the barrel 1 through the vents 48. The other end of the hood 49 is connected to a duct 50 which is connected to a dust collector 51. The collector 51 communicates with a vacuum source (not shown).

During barrel finishing, any attrition dust in the air is sucked by the vacuum source as shown by air flow lines 53. The air flow passing through the barrel lowers the frictional heat of the mass and the barrel as mentioned above.

When the finishing is completed, the mass is discharged from the barrel through a chute 52 attached to the side wall 33.

Figure 6:
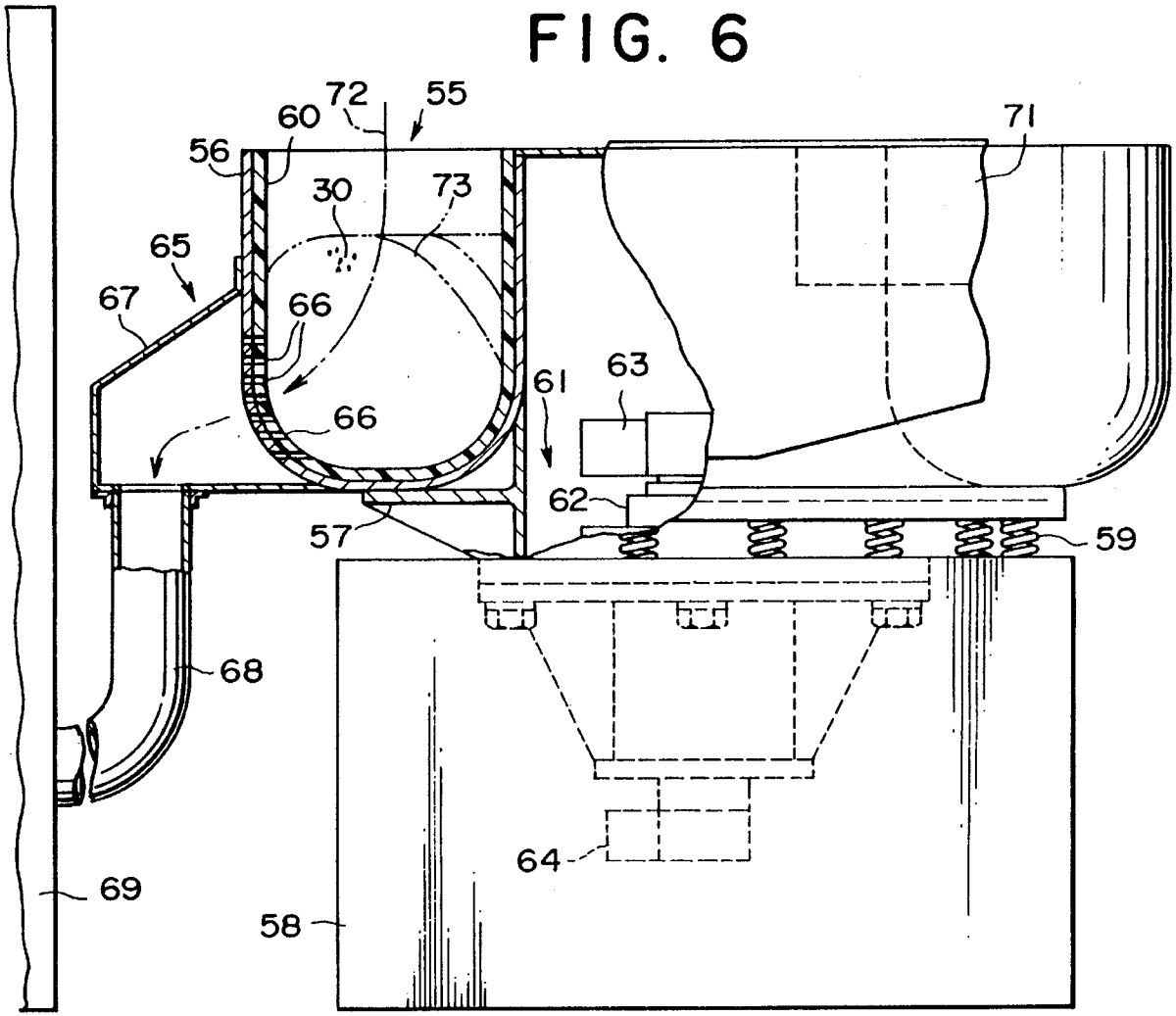
FIG. 6 is a partially sectional front view of a dry-type barrel finishing machine of the present invention and having a vibratory barrel.
Figure 7:
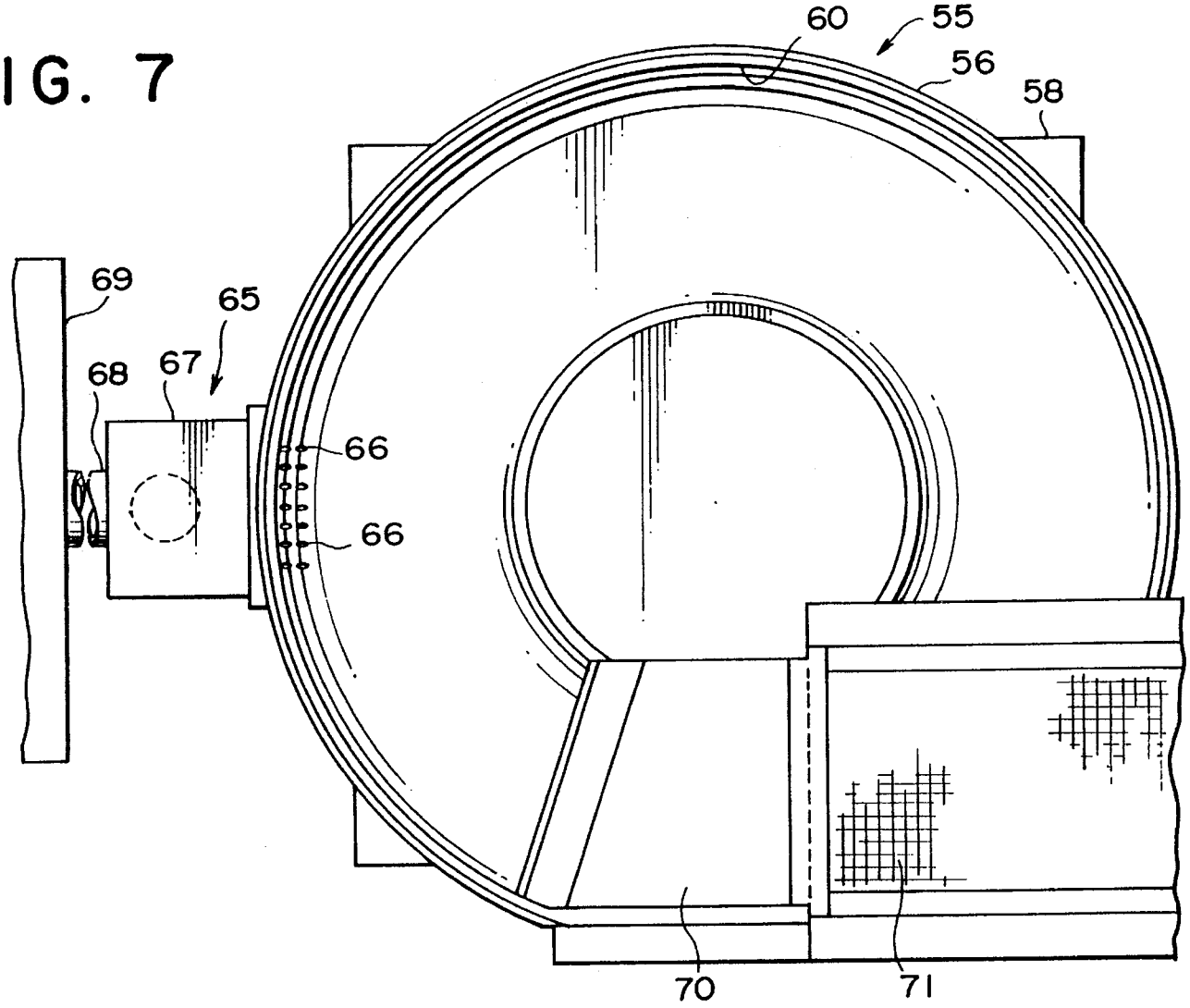
FIG. 7 is a plan view of the machine of FIG. 6.

In FIGS. 6 and 7, another embodiment of the dry barrel finishing machine of the present invention is shown. The machine has an annular barrel 55. As shown in FIG. 6, the barrel 55 has a U-shaped wall 56. The bottom of the barrel may be round, as shown in FIG. 6, or flat. The barrel is mounted on a horizontal circular table 57. The table 57 is supported by a plurality of elastic members 59, for example, coil springs. A box-like base 58 for supporting the table 57 is disposed under the table 57. The elastic members are secured to the top portion of the base 58. The U-shaped inner wall surface of the barrel is covered with a liner 60.

As will be understood from FIG. 6, a driver 61 is suspended from the top portion of the base 58. The driver 61 is located at the central portion of the annular barrel 55. The driver 61 includes a motor 62 vertically mounted on the base 58. The motor 62 extends both upwards and downwards from the top portion of the base. The output shaft of the motor 62 also extends upwards and downwards. The motor includes a pair of counterweights 63, 64 attached to the upper and lower ends of the output shaft. The counterweights are designed so as to locate at vertically aligned positions. Since the rotation of the counterweights causes the top portion of the base to deflect and the elastic members to act, the barrel effectively vibrates.

An air suction device 65 is provided at the outer lower part of the barrel 55 as shown in FIGS. 6 and 7 for the same purpose as those of the machines described relating to FIGS. 1 and 2 and FIGS. 4 and 5. Also, a plurality of small holes 66 are formed in the outer lower part of the barrel. The suction 65 is connected to a duct 68 through a hood 67. The duct is connected to a vacuum source (not shown) through a dust collector 69. In the example shown in the drawings, only one air suction device is provided. However, a plurality of air suction devices may be provided at some circumferential portions of the barrel so that the attrition dust can be more effectively caught and borne by the air. In this case, the air suction devices may be connected to one or more ducts which are connected to the dust collector.

As shown in FIG. 7, the barrel 55 is provided with a plate flapper 70. The flapper 70 is rotatably mounted on the barrel and is recedable therefrom when not used. The distal end of the flapper 70 is put into the passage of the mass to take out the finished workpieces and the remaining media from the barrel. The flapper 70 serves as a guide for guiding the mass onto a screen 71 mounted on the barrel. The mass discharged from the barrel is separated on the screen 71 into the finished workpieces and the worn media.

The operation of the machine will now be explained. When the mass consisting of the media 30 and suitable workpieces are placed in the barrel 55 of the machine, the motor 61 and the vacuum source for the dust collector 69 are activated. As a result, the counterweights 63, 64 rotate. This causes the barrel 55 on the table 57 to move vertically and horizontally or swing by the action of the elastic members 59. Therefore, the mass flows in the barrel in directions shown by flow lines 73 while moving along the annular barrel. Thus, the workpieces are finished.

By the air suction device or suctions disposed under the barrel, the same effects can be obtained during finishing, as in the machines of FIGS. 1 and 2 and FIGS. 4 and 5.

When finishing is completed, the flapper 70 is rotated by a lever (not shown) so that the flapper is placed into the barrel. Therefore, the mass flowing along the annular barrel is carried on the flapper 70 and then onto the screen 71, where the mass is separated into the finished workpieces and the worn media. They may be further treated or processed. When the mass is discharged from the barrel, the motor 61 and the dust collector are stopped, and the flapper 70 is returned to its original position.

In the above embodiments, some drivers are used. It is, however, apparent to those skilled in the vibrating art that any other known mechanical, electrodynamic, or electromagnetic driver may be used. One skilled in the art will appreciate that the present invention can be practiced by other than the described embodiments, which are presented for the purposes of illustration and not of limitation, and that the present invention is limited only by the claims that follow.

We claim:

1. A dry barrel finishing machine, comprising:

a base;

a barrel mounted on the base for accommodating a mass consisting of a media and workpieces, each media being porous and provided at the outer surface with no skin layer of bonding plastic material which is used for combining abrasive grains;

a driving means for flowing the mass in the barrel;

an air suction device mounted on one end of the barrel, the air suction device allowing air in the barrel to flow through the mass;

a filtering means for preventing the mass from exiting the barrel via the air suction device; and a dust collector connected to the air suction device for sucking the air with attrition dust therein through the air suction device.

2. The machine of claim 1, wherein the barrel includes:

an immobile hollow cylindrical tank, the inner surface thereof being covered with a liner;

a supporting plate mounted on the base for supporting the immobile tank; and a rotary plate mounted on a vertical rotary shaft on the base so as to be located above and spaced apart from the supporting plate, thereby forming a passage for the air from the barrel to the air suction device, the rotary plate being covered with a liner, a slit being formed between the lower portion of the liner on the inner wall of the tank and the edge of the liner on the rotary plate, said passage communicating with the barrel through the slit.

3. The machine of claim 2, including a motor mounted under the supporting plate for rotating the rotary plate on the vertical shaft to flow the mass in the barrel.

4. The machine of claim 2, wherein the air suction device includes a suction hole formed in the supporting plate, the hole being opened to the passage, and a duct connected at one end to the hole and at the other end to the dust collector.

5. The machine of claim 3, wherein the air suction device includes a suction hole formed in the supporting plate, the hole being opened to the passage, and a duct connected at one end to the hole and at the other end to the dust collector.

6. The machine of claim 2, wherein the supporting plate is rotatably mounted on the base so as to turn about a horizontal axis.

7. The machine of claim 1, wherein the barrel includes a U-shaped channel, and wherein the barrel is vibratingly supported on the base through a plurality of elastic members.

8. The machine of claim 7, wherein the driving means include a driver for flowing the mass in the barrel.

9. The machine of claim 7, wherein the air suction device includes a plurality of air-suction holes, a hood covering the holes, and a duct connected to the hood at one end and to the dust collector at the other end.

10. The machine of claim 1, wherein the barrel is annular, and wherein the driving means include a driver for flowing the mass in the barrel.

11. A dry barrel finishing machine, comprising:

a base a barrel for accommodating a mass consisting of workpieces and a media, the barrel being open to the air at an upper part and having an air suction device at a lower part;

means for supporting the barrel, the supporting means mounted under the barrel and including a plurality of elastic members mounted on the base, the elastic members supporting the barrel such that the barrel can move elastically; and cam means mounted on the supporting means for displacing the supporting means vertically and horizontally.

12. A method of dry barrel finishing, comprising the steps of:

charging into an open barrel a mass consisting of a mixture of workpieces and media, the media being produced by heating in mold a mixture of abrasive grains and plastic grains by a high-frequency heater so as to combine the abrasive grains so that each media has suitable pores therein, but has on the outer surface no skin layer of the plastic;

flowing the mass in the barrel; and sucking air into the open barrel while the mass is flowing so that air can pass through the mass, thereby lowering frictional heat caused by the attrition of the mass and the barrel and discharging the air as well as the attrition dust borne in the air.

13. The method of claim 12, wherein the air in the barrel is sucked from a portion below the barrel.

* * * * *